United States Patent [19]

Fleissner

[11] Patent Number: 5,052,197

[45] Date of Patent: Oct. 1, 1991

[54] APPARATUS FOR FLOW-THROUGH TREATMENT OF TEXTILE MATERIAL, PAPER OR THE LIKE

[75] Inventor: Gerold Fleissner, Chur, Switzerland

[73] Assignee: Fleissner Maschinenfabrik AG, Rebstein, Switzerland

[21] Appl. No.: 490,412

[22] Filed: Mar. 8, 1990

[30] Foreign Application Priority Data

Mar. 8, 1989 [DE] Fed. Rep. of Germany ..... 3907421

[51] Int. Cl.[5] ..... D06B 5/08

[52] U.S. Cl. ..... 68/5 D; 68/158; 68/903; 34/123

[58] Field of Search ..... 68/903, 5 D, 5 E, 158, 68/184; 34/111, 122, 123, 139

[56] References Cited

U.S. PATENT DOCUMENTS 4,811,574 3/1989 Fleissner ..... 68/5 D 4,912,945 4/1990 Fleissner ..... 68/5 D

*Primary Examiner*—Philip R. Coe

*Attorney, Agent, or Firm*—Antonelli, Terry, Stout & Kraus

[57] ABSTRACT

A highly permeable drum for the wet or dry treatment of textile material, paper or other permeable materials of a certain width consists solely of narrow sheet metal strips and narrow webs, the extension in width of which is oriented in the radial direction. The sheet metal strips extend axially parallel, and the spacers extend perpendicularly thereto. In accordance with further development of this known structure, the connecting-locking elements to be arranged between the sheet metal strips consist of elements extending from a space between two sheet metal strips into the neighboring space. The result is a simple, readily mountable, and more lightweight construction of the drum shell.

21 Claims, 2 Drawing Sheets

APPARATUS FOR FLOW-THROUGH TREATMENT OF TEXTILE MATERIAL, PAPER OR THE LIKE

BACKGROUND OF THE INVENTION

The invention is related to an apparatus for the flow-through treatment of textile material, non-wovens, or paper, with a gaseous or liquid treatment medium circulated within the entire apparatus, comprising a permeable drum as a conveying element subjected to through-flow from the outside toward the inside, said drum being under a suction draft and exhibiting end plates at the end faces, said drum being covered on its periphery with a screen-type cover, sheet metal strips extending in the axial direction being arranged in width of these sheet metal strips running substantially in the radial direction, and connecting elements which connect the sheet metal strips being provided in the peripheral direction between the sheet metal strips and more particularly, to such an apparatus wherein the connecting elements are connecting-locking elements that:

(a) are each of one piece, i.e., have a unitary structure, (b) are each fashioned with a connecting portion with a width corresponding to the desired spacing of the immediately adjacent sheet metal strips, (c) are each connected with an adjacent sheet metal strip, and furthermore (d) are provided at least on one side with a locking element portion which can be, respectively, pushed through a corresponding opening in the associated sheet metal strip.

An apparatus of this type has been described in German Patent Application P 38 02 791.7 and corresponding U.S. Pat. No. 4,811,574. This structure has the advantage of eliminating the conventional, complicated honeycomb arrangement according to U.S. Pat. No. 3,590,453 wherein the drum body is made up of metal strips extending in a zigzag shape in the axial direction and being joined by welding, in such a way that the screen-shaped cover has a honeycomb-like structure. In order to be able to connect the elements of this drum structure with one another, a voluminous welding operation must be performed which is not only expensive with respect to the assembly but also is disadvantageous in that the total construction will be warped on account of the high temperature curing the extensive welding work. For this reason, true-running accuracy of said welded honeycomb structures is possible only by considerable additional work after assembly. The construction according to the above-indicated German patent application proceeds along a different route by placing readily mountable spacers between the sheet metal strips and connecting these spacers with the sheet metal strips by means of screws or rivets. An apparatus of this type has proven to be definitely of advantage under practical conditions, but it cannot be utilized for all applications. In particular, it has been found that the total construction of the drum construction as a considerable weight; actually, such a weight provides a corresponding ruggedness of the arrangement. In case of drums which must be driven at a high speed of rotation, for example for the drying of paper or the production of nonwovens, this screw construction can, however, lead to disadvantages.

The invention is based on the object of finding drum construction which still exhibits the optimum permeability of more the 90%, but yet is simpler in assembly, due to the fact that the known screw construction is avoided, and can yet be manufactured with considerably greater ease while retaining the stability of the total structure.

Starting with the apparatus of the type heretofore described wherein, according to the aforementioned German patent application, a peg-shaped spike is pushed through a corresponding opening in the adjacent sheet metal strip and a nut is screwed onto the spike for fastening this connection element to the sheet metal strip, the invention now proceeds along a different route. The essential basic idea resides in that the locking element portion of each connecting-locking element, pushed through the sheet metal strip, can be fixedly adjusted or fixedly jointed to the adjacent second connectinglocking element, i.e., the connecting portions of this element. Thus, in contrast to the state of the art, the respective connecting-locking element is not joined to one of the sheet metal strips in this arrangement but rather the connecting elements are joined together. The connection can be effected in a simple way by welding; the weld seams need not provide the ruggedness of the total structure over a relatively long length, but rather a short weld seam is sufficient for the force-derived connection of a locking element with the subsequent connecting element. Warping of the total structure thus is precluded thereby.

This basic idea covers quite a number of embodiments, each of which is inventive. For example, the connecting-locking element can advantageously consist merely of a radially extending web having a thickness corresponding to the sheet metal thickness and being additionally provided with a unilaterally located T-flange, the locking element portion that can be pushed through an opening in the sheet metal strip being disposed on the other side of this flange. The locking element portion of this composite connecting-locking element should be fashioned as a bolt which has in its center a slot oriented in parallel to the web and corresponding to the thickness of the web. The mounting of such a web-bolt structure is very simple. It is possible, for example, to preassemble the respective connecting-locking elements with a sheet metal strip, by joining the respective T-flange with the sheet metal strip by a short weld seam. Subsequently, the individual sheet metal strips provided with the connecting-locking elements are pushed radially inwardly into the drum structure, namely in such a way that the radially extending webs are pushed between the halved bolts. The bolts then are to be welded to the webs whereupon a further series of connecting-locking elements can be mounted.

Another, similarly advantageous structure consists in that the connecting-locking element is a pipe with a unilaterally arranged spike which can be pushed through an opening in the sheet metal strip, the outer diameter of this spike corresponding to the inner diameter of the pipe. These connecting-locking elements cannot be displaced radially into the drum structure for mounting purposes but rather must be arranged in a series one behind the other in the peripheral direction, but here again a rugged total construction is attainable without the necessity for extensive welding work and without giving the total structure a considerable weight. the weld seam in this arrangement is merely the connection of the pipe with the spike; this can be accomplished through an opening in the pipe.

Another advantageous connecting-locking element comprises a radially extending web likewise having a thickness corresponding to the sheet metal thickness, but in this case the locking element portio is constituted of a finger-like sheet metal strip which is narrower as compared with the height of the web; this strip can, in turn, be pushed through an opening in the axially extending sheet metal strip and can be welded to the next-following connecting-locking element oriented in parallel to the web. These connecting locking elements thus consist in total only a of a piece of sheet metal which can be punched during manufacture. The respectively adjacent connecting elements thus cover one another in parallel and consequently can be joined into a rugged total structure by a simple weld seam.

The connecting-locking elements, however, can also be fashioned in a manner of snap fasteners wherein the head of the respective snap fastener part corresponds in its width to the desired spacing of the sheet metal strips and has, in its body, a cavity with an opening for the insertion of the round snap fastener pin. In this arrangement, assembly is especially simple because the snap fasteners are suitable joined after assembly to the axially extending sheet metal strips by means of a weld seam.

Heretofore, the connecting element consisted in each case of an element joined to a locking element which was insertable through the axially extending sheet metal strip so that in each case a locking element could be welded to a neighboring connecting element. In a further embodiment, this idea of joining a first space between two axially extending sheet metal strips with the neighboring space tween two sheet metal strips be means of elements extending through both spaces has been further developed in consequent fashion by providing that the locking element can be pushed through more than one of the successive sheet metal strips, for example, by making the connecting-locking element of at least one sheet metal profile extending around the drum, this profile then being welded, during assemblage, to the axially extending sheet metal strips in correspondence with their desired spacing.

The drawings show several embodiments of the apparatus according to this invention. Still further details of the invention will be described in greater detail below with reference to these embodiments; these details are then also of inventive significance in conjuction with the basic construction.

DETAILED DESCRIPTION OF THE INVENTION

Figure 1:
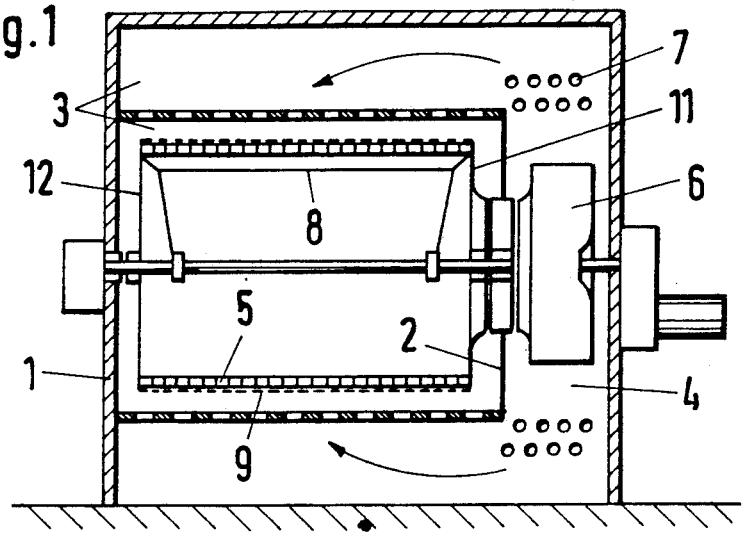
FIG. 1 shows a section longitudinally through a sieve drum drying device, but with a drum shell that is not perforated but rather made of a sheet metal strip structure.

The sieve drum apparatus according to FIG. 1 consists of a rectangular housing 1 subdivided by a partition 2 into a treatment chamber 3 and a fan chamber 4. In the treatment chamber 3, a sieve drum 5 is rotatably supported and, concentrically thereto, a fan 6 is rotatably mounted in the fan chamber 4. The fan chamber 4 can, of course, also be arranged in a segregated, separate fan housing, not shown herein. In any event, the fan 6 places the interior of the sieve drum 5 under a suction draft by way of its open end face. The application likewise covers the drum construction in connection with a wet treatment device which can also serve merely for suction removal of a liquid or for the wet stitching of nonwovens. The total structure then must be adapted correspondingly.

According to FIG. 1, heating units 7 are respectively located above and below the fan 6; these heating units 7 consist of pipes traversed by a heating medium. In general, the sieve drums of the structure here of only interest, which structure is up to 90% air-permeable, are built with a very large diameter, and the sieve drum 5 is covered during the heat treatment with the textile material or paper to be treated over almost the entire peripheral surface area. In the some of the feeding and removal of the textile material, however, the sieve drum 5 is to be shielded from the inside against the inwardly prevailing suction draft; for this reason, FIG. 1 shows the inner protective cover 8. However, the latter, in this embodiment, could also be fixedly mounted at the level of the drum axis. On the outside, a fine-mesh screen 9 is wrapped around the sieve drum shell and is attached at the end faces of the drum to the two end plates 11, 12.

The drum structure consists of axially oriented sheet metal strips 10; their extension in width can be seen, for example, from FIGS. 2, 5, 8, 12, and 14 and runs in the radial direction. Therefore, the screen-type cover 9 rests basically only on the edges of the sheet metal strips 10 that are arranged radially on the outside and on the edges of the connecting elements arranged perpendicularly thereto, which in the embodiments may exhibit a short web 13 (FIGS. 5, 6) radially on the outside, the screen-like cover 9 likewise resting thereon. This short web 13 can also be omitted, in which case the screen-like cover would rest solely on the sheet metal strips 10. The sheet metal strips 10 are attached to the two end plates 11 and 12 with a defined mutual spacing in side-by-side relationship. In order to maintain this spacing constant over the width of the sieve drum 5, the connecting elements denoted by reference numeral 14 in their entirety are provided which serve as spacers; these connecting elements 14—and this hold true for all embodiments—extend not only in the space between two neighboring axially extending sheet metal strips 10, but also continue additionally into the adjacent interspace between an additional sheet metal strip and are there fixedly connected to a second connecting element arranged at that location, by means of a welding step.

Figure 2:
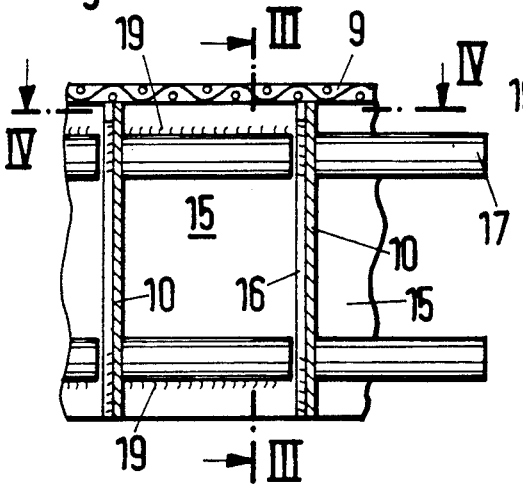
FIG. 2 shows an embodiment with radially insertable connecting-locking elements.
Figure 3:
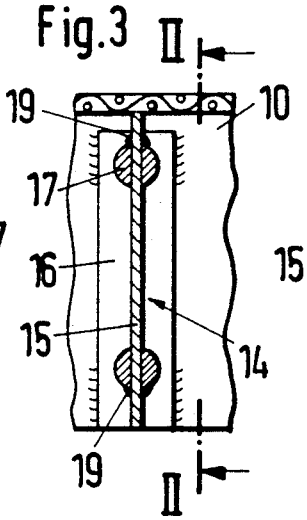
FIG. 3 and 4 being sections taken along the lines III—III and IV—IV, respectively in FIG. 2.
Figure 4:
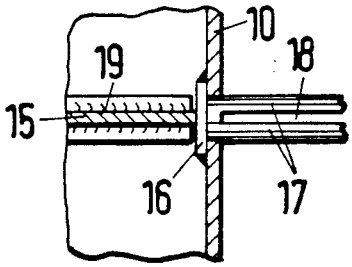

In the embodiment according to FIGS. 2-4, the connecting-locking element consists of a radially oriented web 15 having a thickness corresponding to the thickness of the sheet metal strip 10; this web 15 extends over the entire height of an axially oriented sheet metal strip 10. One end face of this web 15, a T-flange 16 shown in FIG. 3 is centrally fastened; this flange is in flat contact with the associated sheet metal strip 10 and is welded to the sheet metal strip 10. On the rear side of this flange 16, two locking elements are arranged at a spacing at the top and at the bottom; these are constructed in accordance with FIG. 3 as bolts 17 and are pushed through circular openings in the sheet metal strip 10 into the space of the neighboring pair of sheet metal strips. The two bolts 17 are each provided in their middle with a slot 18 having a width corresponding to the thickness of the web 15 of the adjacent connecting element can be radially inserted in this slot 18. The respective web 15 of a connecting element 14 is fixedly connected to the bolt 17 of the neighboring connecting-locking element 14 by a short weld seam 19. As can been seen from FIG. 4, the connecting-locking element according to FIG. 2 thus comprises the radially extending web 15 with the T-flange 16 at the end face, the flange 16, in turn, carrying the two bolts 17 on its rear side, these bolts 17 projecting into the adjacent space between the two sheet metal strips 10.

Figure 5:
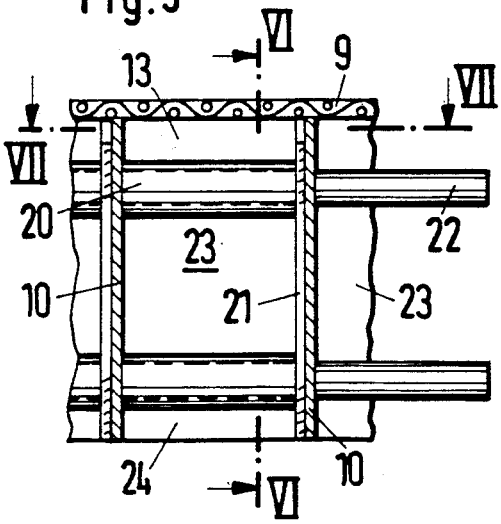
FIG. 5 shows an embodiment of the sheet metal strip structure with connecting-locking elements insertable in the peripheral direction of the drum.
Figure 6:
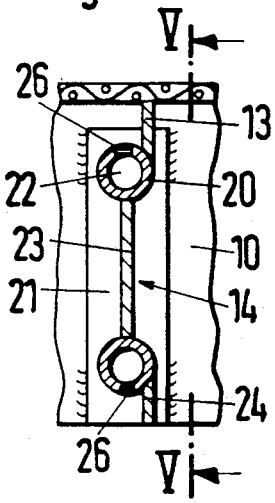
FIGS. 6 and 7 being sections taken along the lines VI—VI and VII—VII, respectively, in FIG. 5.
Figure 7:
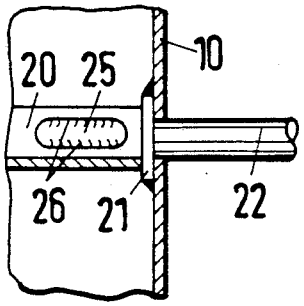
Figure 8:
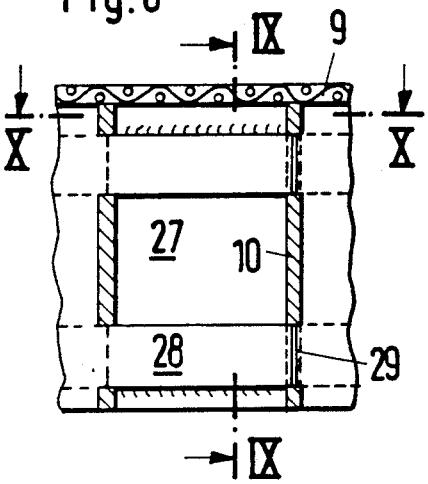
FIG. 8 shows an embodiment wherein the connecting-locking elements consist merely of punched sheet metal pieces.
Figure 9:
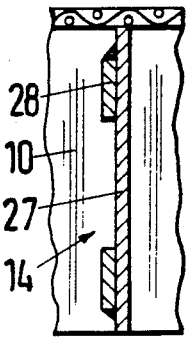
FIGS. 9 and 10 being sections taken along the lines in IX—IX and X—X, respectively, and FIG. 11 being a view of such a punch sheet metal piece.
Figure 10:
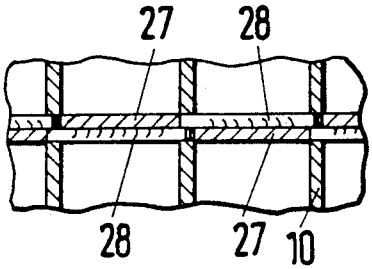

In the embodiment of FIGS. 5-7, the connecting element comprises two superimposed pipes 20 which exhibit, in turn, at the end faces a T-shaped flange 21. On the rear side of this T-shaped flange 21, locking elements or spikes 22 are then located, the outer diameter of these spikes corresponding to the inner diameter of the pipes 20. The sheet metal stirps 10, in turn, exhibit bores or openings at the level of the spikes 22; the locking elements or spikes 22 can be pushed through these bores into the adjacent space between two sheet metal strips 10. The pipes 20 are connected with each other by a radially extending wall or plate 23 and exhibit on their underside the base or flange 24 which can also be designed to be broader, and on their topside the short web or flange 13 which, according to FIG. 6, however, both are arranged to be laterally offset. The reason for this feature resides in the necessity of welding the pipe 20 to the spike 22 of the adjacent connecting element. In order to be able to perform the welding operation more readily, openings 25, necessary for this welding step, are arranged in the pipes 20 radially outwardly and, respectively, inwardly, as can been seen from FIG. 6. The weld seam bears reference numeral 26. As can be seen from FIG. 7, the connecting-locking element of the series of FIGS. 5 to 7 consists, therefore, of the pipes 20, the T-shaped flange 21, and the locking elements or spikes 22. Each pipe 20 has a length, together with the T-shaped flange 21, corresponding to the spacing between two neighboring sheet metal strips 10.

Figure 11:
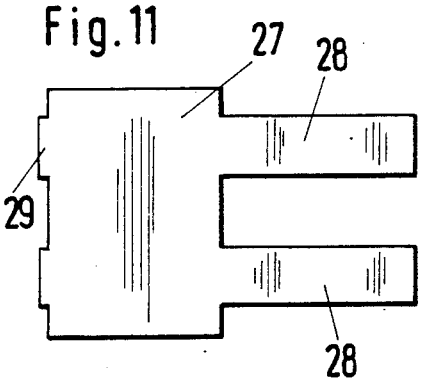

The connecting-locking element of the embodiment shown in FIGS. 8 to 11 comprises a radially extending sheet metal piece 27 which is visible especially in FIG. 11; this sheet metal piece 27 exhibits the thickness of a sheet metal strip 10 over its entire area. Two fingers 28 fashioned as finger-like sheet metal strips, adjoin the side of the sheet metal piece 27; these fingers 28 here again take care of locking the connecting-locking element in place and are pushed through openings of the axially extending sheet metal strips 10. The fingers 28 are in parallel contact—as can been seen from FIG. 10—with the respectively adjacent sheet metal piece 27 are welded to this piece. The openings which are also necessary in this embodiment in the axially extending sheet metal strips 10 for pushing the connecting-locking element from one space between two adjacent sheet metal strips into the other space basically require a cross section corresponding to that of a finger 28, e.g., a rectangular section. In the embodiment, as can be seen especially from FIGS. 8 and 10, these openings are, however, fashioned to correspond to twice the sheet metal thickness of the sheet metal piece 27, 28. This feature brings the advantage that it is possible to insert in this opening and/or to center therein not only the finger 28 in its entirety but also the end of the sheet metal piece 27 located in front or behind this finger 28. As can be seen from FIG. 11, the sheet metal piece 27 exhibits at the level of the fingers 28 an adjusting tab 29 which can likewise be inserted in the rearwardly located openings of the sheet metal strips 10. If, then, the finger-like sheet metal strip 28 is designed to be longer by half the sheet metal thickness of the axially oriented sheet metal strip 10 than the desired spacing of the two directly adjacent sheet metal strips 10, the sheet metal strips of the preceding and of the following connecting-locking elements 14 con in contact with this opening, as can be seen from FIGS. 8 and 10.

Figure 12:
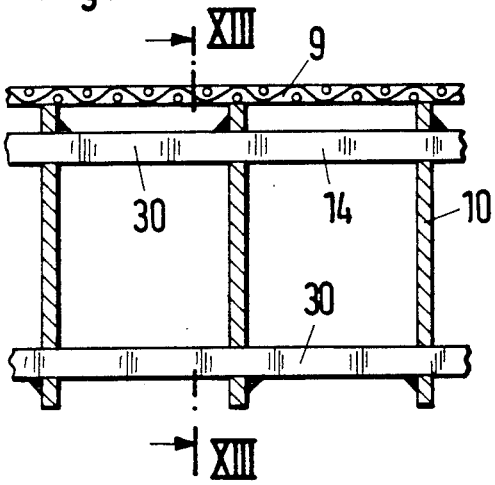
FIG. 12 shows an embodiment wherein the connecting-locking elements extend through more than one axially extending sheet metal strip, preferably around the drum.
Figure 13:
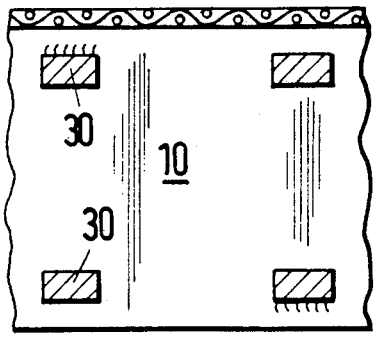
FIG. 13 being a section taken along the line XIII—XIII in FIG. 12.

In the embodiment of FIGS. 12 and 13, the connecting-locking element 14 is pushed not only through an opening in the respective, axially extending sheet metal strip 10, but through several of the openings provided in the spaced metal strips 10. In this embodiment, the connecting-locking element 14 even extends around the drum 5 in the shape of a circularly extending sheet metal profile 30, fashioned of a width corresponding to the desired spacing of immediately adjacent sheet metal strips 10, which is then to be welded along weld seams 40 to the axially oriented sheet metal strips 10 in correspondence with the desired spacing. The desired spacing of the axially oriented sheet metal strips 10 is determined or maintained during the welding operation by spacer shims designed to be removable after assembly and not illustrated in the drawings. Since the connecting element thus extends through several openings in the axially oriented sheet metal strips, the weld seams 40 are needed only alternatingly in one space or in the next but one space between two such sheet metal strips 10. The result of such a welding step can be seen from FIG. 12. FIG. 13 furthermore shows that the short webs 13 present in the other embodiments for supporting the screen-like cover 9 can also be omitted.

Figure 14:
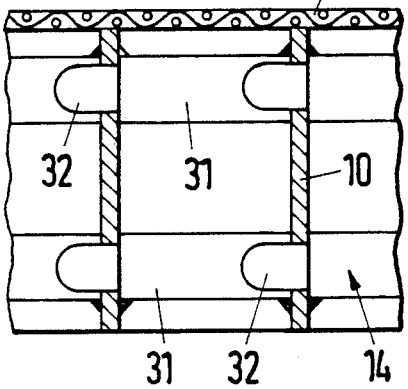
FIG. 14 shows an embodiment wherein connecting locking elements are connected with neighboring connecting-locking by means of a locking device similar to a snap fastener.

The latter also holds true in the embodiment of FIG. 14 wherein the axially extending sheet metal strips 10, arranged side-by-side, are joined by connecting-locking elements 14 similar to snap fasteners. In this arrangement, the head 31 of such a snap fastener-like element corresponds in its width to the desired spacing of the adjacent axially oriented sheet metal strips 10 and has in its body a cavity for the insertion of the round member 32 of the snap fastener. After the assembly, which proceeds quickly, the bodies of the respective connecting element must then be welded to the sheet metal strips 10.

What is claimed is:

1. An apparatus for the flow-through treatment of textile material, nonwovens, or paper, with a gaseous or liquid treatment medium circulated therein, comprising a permeable drum as a conveying element subjected to throughflow from the outside toward the inside, said drum being under a suction draft and having end plates at its end faces, said drum being covered on its periphery with a screen type cover, sheet metal strips extending in an axial direction and being arranged between the end plates of the drum, an extension in width of these sheet metal strips running substantially in a radial direction, and connecting-locking elements which connect the sheet metal strips provided in a peripheral direction between the sheet metal strips, wherein said connecting-locking elements (a) are each of a unitary structure, (b) are each provided with a connection portion having a width corresponding to a desired spacing of immediately adjacent sheet metal strips, (c) are each connected with an adjacent sheet metal strip, and (d) are each provided at least on one side with a locking element portion which can be respectively inserted through a corresponding opening in an associated sheet metal strip; the locking element portion of a first connecting-locking element being fixedly adjusted at an adjacent second connecting-locking element.

2. Apparatus according to claim 1, wherein the locking element portion can be fixedly connected to the adjacent second connecting-locking element.

3. Apparatus according to claim 2, wherein the connection is effected by welding.

4. Apparatus according to any one of claims 1 to 3, wherein the connecting-locking element comprises a radially extending web with a unilaterally arranged T-flange, said web having a thickness corresponding to a sheet metal thickness of a sheet metal strip, the locking element portion which can be pushed through an opening in the sheet metal strip being located on an other side of the T-shaped flange.

5. Apparatus according to claim 4, wherein the locking element portion comprises a bolt which has in its middle a slot oriented in parallel to the web and having a width corresponding to the thickness of the web.

6. Apparatus according to claim 5 wherein a flank of a halved portion of bolt is welded to an interposed web of the second connecting-locking element.

7. Apparatus according to claim 6, wherein two bolts are arranged at the level of the web or of the T-flange.

8. Apparatus according to claim 7, wherein the T-flange of the respective web is welded to an associated, axially extending sheet strip.

9. Apparatus according to any one of claims 1 to 3, wherein the connecting locking element comprises a pipe and an unilaterally arranged spike that can be pushed through an opening in the sheet metal strip, the outer diameter of this spike corresponding to an inner diameter of the pipe.

10. Apparatus according to claim 9, wherein the pipe has over a partial length thereof, an opening, the pipe and the inserted spike of an adjacent connecting locking element being weldable together along the boundary zone of this opening.

11. Apparatus according to claim 9, wherein the connecting-locking element consists of two superimposed pipes joined together by a radially extending wall, a T-flange being arranged on one side of these pipes, the spikes which can be pushed through the openings in the sheet metal strip being arranged on the other side thereof.

12. Apparatus according to claim 11, wherein a narrow strip supporting the screen-like cover is arranged radially outwardly of an outer pipe, and a wider foot is arranged radially inwardly of an inner pipe.

13. Apparatus according to claim 12 wherein the opening in a radially outwardly disposed pipe is provided radially outwardly, and the opening in a radially inwardly lying pipe is provided radially inwardly, and the strip and the foot are mounted to be laterally offset with respect to the wall.

14. Apparatus according to any one of claims 1 to 3 wherein the connecting-locking element consists of only one, radially extending sheet metal piece having a thickness corresponding to the thickness of the sheet metal, wherein a locking element portion is formed from a finger which is narrower with respect to the height of the sheet metal piece, said finger being pushed through an opening in an axially extending sheet metal strip, being arranged in parallel to an adjacent sheet metal piece, and being weldable to the latter.

15. Apparatus according to claim 14, wherein the opening in the axially extending sheet metal strip corresponds in the width, axial with respect to the drum to twice the sheet metal thickness, and a free end of a finger of a first connecting-locking element can be inserted in said opening together with a sheet metal piece of a second connectinglocking element.

16. Apparatus according to claim 15, wherein the opening in the axially extending metal strip serves as a centering means for a respective free end of a finger and, for this purpose, the finger is designed of a greater length than corresponds to a desired spacing of two directly adjacent, axially extending sheet metal strips.

17. Apparatus according to claim 16, wherein the finger is longer by half the sheet metal thickness of an axially oriented sheet metal strip that corresponds to the desired spacing of the two directly adjacent, axially extending sheet metal strips, and the sheet metal piece exhibits, on the rear side located in opposition to the respective fingers, an adjusting tab, the depth of which likewise corresponds approximately to half the sheet metal thickness of an axially oriented sheet metal strip.

18. Apparatus according to any one of claims 1 to 3, wherein the connecting-locking element is fashioned to be similar to a snap fastener and a head of the snap fastener corresponds in its width to a desired spacing of adjacent, axially oriented sheet metal strips, and has in its body a cavity for insertion of a round member of the snap fastener.

19. Apparatus for the flow-through treatment of textile material, nonwovens, or paper, with a gaseous or liquid treatment medium circulated therein, comprising a permeable drum as a conveying element subjected to throughflow from the outside toward the inside, said drum being under a suction draft and having end plates at end faces, said drum being covered on its periphery with a screen-type cover, sheet metal strips extending in an axial direction and being arranged between the end plates of the drum, an extension in width of said sheet metal strips running substantially in a radial direction, and connecting-locking elements which connect the sheet metal strips being provided in a peripheral direction between the sheet metal strips, which elements (a) are each of one piece, (b) are each operatively associated with a removable spacer of a width corresponding to a desired spacing of the immediately adjacent sheet metal strips, (c) are each connected with adjacent sheet metal strips, and (d) are provided at least on one side with a locking element portion which can be respectively inserted through a corresponding opening in an associated sheet metal strip, wherein the locking element portion can be pushed through more than one of the subsequent, axially arranged sheet metal strips.

20. Apparatus according to claim 19, wherein the connecting-locking element comprises at least one sheet metal profile extending the drum, this profile being welded in correspondence with the desired spacing to the axially oriented sheet metal strips.

21. Apparatus according to claim 20, wherein the desired spacing of the axially oriented sheet metal strips is determined during a welding operation by means of a plurality of the removable spacers which comprise spacer shims designed to be removable after assembly.

* * * * *